US007975596B2

(12) United States Patent
Darian

(10) Patent No.: US 7,975,596 B2
(45) Date of Patent: Jul. 12, 2011

(54) FIREARM

(76) Inventor: Rubik Darian, Glendale, CA (US)

( * ) Notice: Subject to any disclaimer, the term of this patent is extended or adjusted under 35 U.S.C. 154(b) by 283 days.

(21) Appl. No.: 12/386,698

(22) Filed: Apr. 21, 2009

(65) Prior Publication Data

US 2010/0263527 A1 Oct. 21, 2010

(51) Int. Cl.
*F41A 5/00* (2006.01)

(52) U.S. Cl. ..... 89/191.01; 89/192; 89/193; 42/69.02; 42/6

(58) Field of Classification Search ..... 89/191.01–193; 42/69.02, 6
See application file for complete search history.

(56) References Cited

U.S. PATENT DOCUMENTS

| | | | | |
|---|---|---|---|---|
| 3,360,878 | A * | 1/1968 | Robinson, Jr. | 42/16 |
| 4,471,549 | A * | 9/1984 | Brint et al. | 42/15 |
| 4,505,182 | A * | 3/1985 | Sullivan | 89/132 |
| 5,050,481 | A * | 9/1991 | Knight et al. | 89/147 |
| 6,382,200 | B1 * | 5/2002 | Levkov | 124/73 |
| 7,555,977 | B2 * | 7/2009 | Crotty et al. | 89/1.35 |
| 7,743,543 | B2 * | 6/2010 | Karagias | 42/69.02 |
| 7,866,310 | B2 * | 1/2011 | Halmone | 124/73 |
| 7,886,470 | B1 * | 2/2011 | Doiron | 42/69.02 |

* cited by examiner

*Primary Examiner* — Bret Hayes
*Assistant Examiner* — Michael D David
(74) *Attorney, Agent, or Firm* — James E. Brunton

(57) ABSTRACT

An improvement to a firearm of the character having an upper receiver, an operating rod operably associated with the upper receiver for movement between a first position and a second position, and a lower receiver connected to the upper receiver. The improvement concerns a novel bolt and barrel lock and release mechanism carried by the upper receiver and a novel trigger mechanism carried by the lower receiver.

9 Claims, 10 Drawing Sheets

FIREARM

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

The present invention relates generally to firearms. More particularly, the invention concerns an improved firearm having a novel receiver, a novel barrel and bolt lock and release mechanism, a novel trigger mechanism and a novel ignition system.

2. Description of Related Art Including Information Disclosed Under 37 CFR 1.97 and 1.98

Present day firearms typically embody basic design concepts that were developed decades ago. As a general rule, improvements made to firearms over recent years have consisted of cosmetic modifications and minor structural changes, most of which do not make any significant improvements to the firearm's core operational features. Accordingly, today's firearms typically do not exhibit significant improvements in the basic construction of the firearm or the manner of its assembly and disassembly.

In modern day firearms the primary structure comprises a receiver, a barrel, a bolt mechanism and a trigger mechanism all connected to a wooden or metal stock. In gas operated semi-automatic firearms, a portion of the propellant gas is diverted from the barrel after passage of the bullet to drive a slide mechanism rearward, which actuates the bolt to extract the empty casing and load a new round. The trigger mechanism is operably associated with the bolt mechanism so that upon operation of the trigger, a firing pin will strike a round disposed within the barrel to fire the bullet.

BRIEF SUMMARY OF THE INVENTION

By way of brief summary, the present invention comprises an improvement to a firearm of the character having an upper receiver, an operating rod operably associated with the upper receiver for movement between a first position and a second position, a lower receiver connected to the upper receiver, a trigger mechanism carried by the lower receiver, and a magazine connected to the lower receiver for carrying a plurality of ammunition cartridges. The improvement here comprises a barrel connected to the upper receiver, the barrel having a rear portion having a curved bearing surface and an intermediate portion having a gas transfer passageway formed therein; a generally semi-circular receiver bearing formed in the upper receiver; a bolt slidably received within the upper receiver for movement between a first forward position and a second rearward position, the bolt having a firing pin; a striker connected to the bolt for movement between a first position and a second position in engagement with the firing pin; a locking member removably connected to the upper receiver for movement relative thereto between a first bolt engaging position and a second bolt disengage position, the locking member having a curved forward portion received within the generally semi-circular bore of the upper receiver and within the curved bearing surface of said barrel; locking member biasing means carried by the upper receiver for urging the locking member into the first bolt engaging position; and a disengage member slidably received within the bolt for movement by the operating rod to move the locking member into the bolt disengage position upon movement of the disengage member to the second position.

With the forgoing in mind, it is an object of the present invention to provide an improved firearm wherein the improvement comprises the provision of a novel barrel lock and release mechanism that greatly simplifies the removal of the barrel of the firearm from the receiver.

Another object of the invention is to provide an improved firearm of the aforementioned character that includes an improved bolt lock and release mechanism that is of simple construction and one that securely locks the bolt in position until it is automatically released upon firing of the weapon.

Another object of the invention is to provide an improved firearm of the character described in the preceding paragraph that includes an improved bolt lock and release mechanism that greatly simplifies the removal of the bolt from the firearm.

Another object of the invention is to provide an improved firearm as described in the preceding paragraphs that includes a novel trigger mechanism that is of simple construction and one that operates to smoothly release the striker of the weapon upon actuation of the trigger.

The forgoing as well as other objectives will be achieved by the novel improved firearm illustrated in the drawings and described in the following paragraphs.

DETAILED DESCRIPTION OF THE INVENTION

Figure 1:
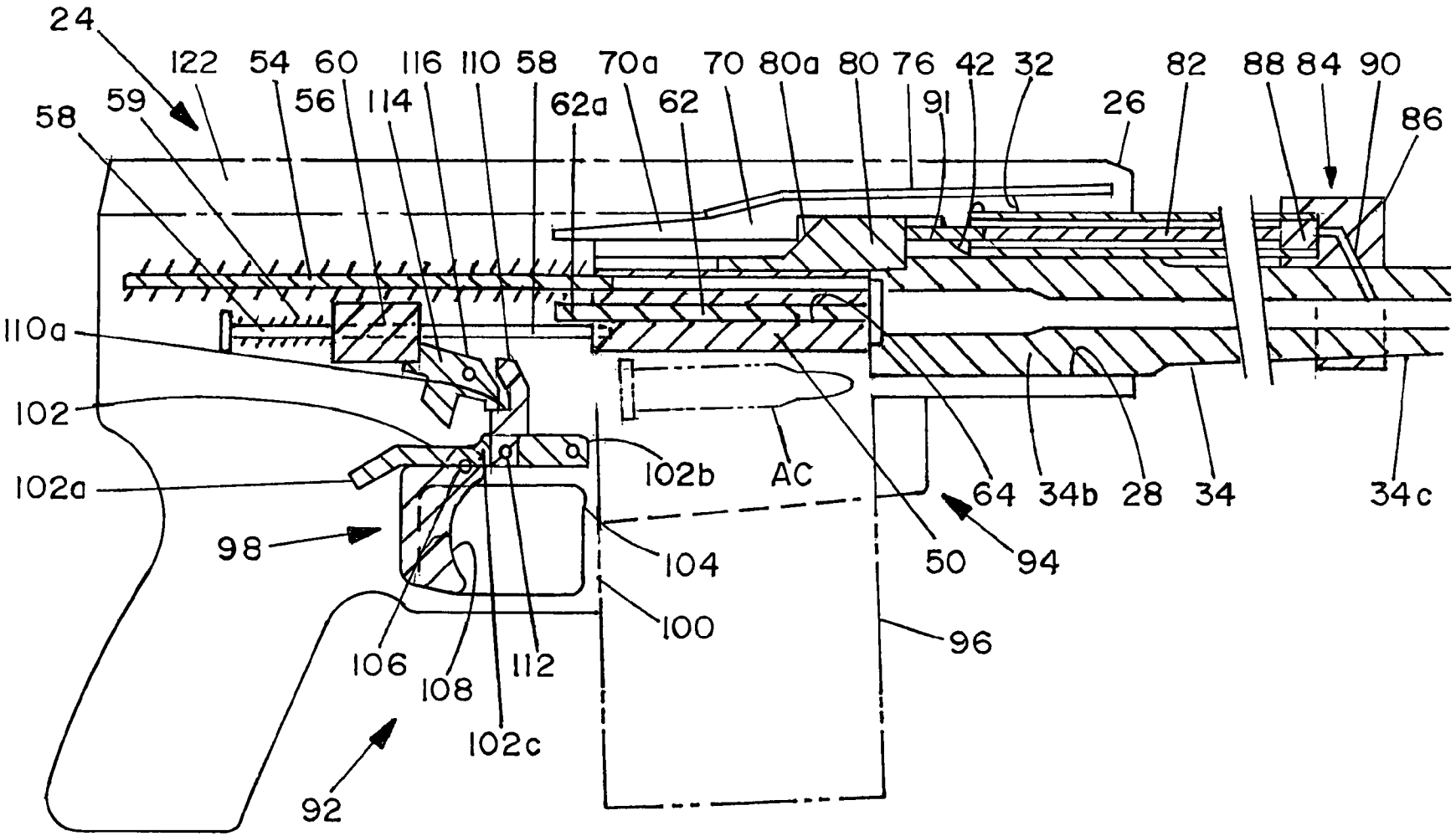
FIG. 1 is a side elevational view, partly in cross-section, illustrating one form of the improved firearm of the present invention.
Figure 2:
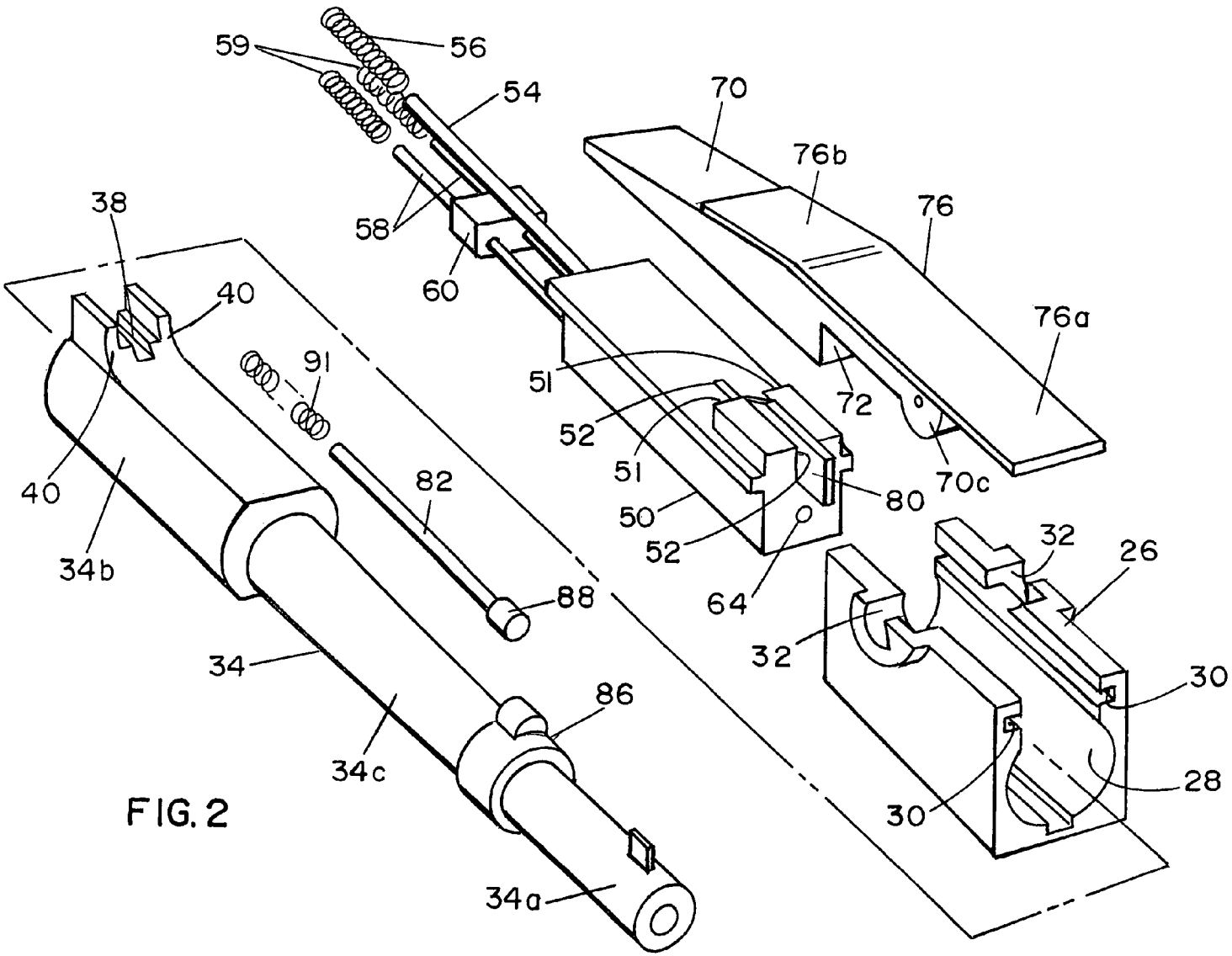
FIG. 2 is a generally perspective, exploded view of the forward portion of the improved firearm shown in FIG. 1.
Figures 3, 5:
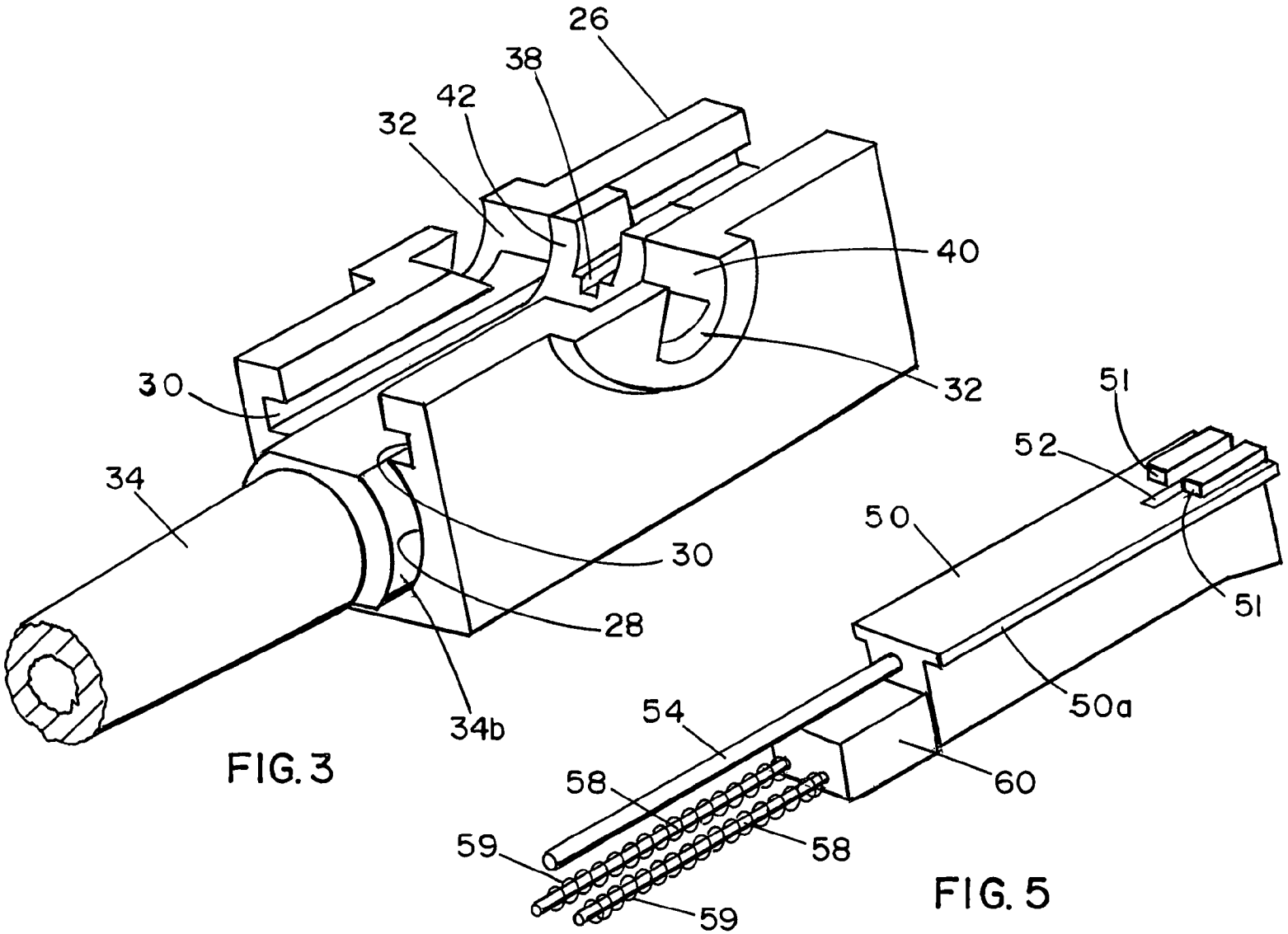
FIG. 3 is a fragmentary, generally perspective view showing the barrel of the firearm received within the upper receiver.
FIG. 5 is a fragmentary, generally perspective view of the bolt of the improved fire arm and showing the striker member of the firearm interconnected with the bolt.

Referring to the drawings and particularly to FIGS. 1 and 2, one form of the firearm of the invention is there shown and generally designated by the numeral 24. In this form of the invention, the firearm comprises an upper receiver 26 having a strategically configured barrel receiving bore 28 and a pair of transversely spaced guide grooves 30 (FIG. 2). An important feature of the present invention is the generally semi-circular shaped receiver bearings 32 that are formed in the front portion of the upper receiver 26 (FIG. 3). The purpose of these receiver bearings will presently be described.

Connected to the upper receiver 26 is a barrel 34 having a forward portion 34*a*, a rear portion 34*b* and an intermediate portion 34*c* disposed between the forward and rear portion. Rear portion 34*b* is provided with a guide slot 38 and a pair of spaced apart, upstanding curved bearing surfaces 40 (FIG. 2). As shown in FIGS. 1 and 3, rear portion 34*b* is telescopically receivable within barrel receiving bore 28 and, when in position within the upper receiver, cooperates with receiver bearings 32 to form a complete receiver bearing 42 that is generally semicircular in cross-section at any point. For a reason presently to be described, the intermediate portion 34*c* of the barrel is provided with a gas transfer passageway 90 (FIG. 1).

Figure 4:
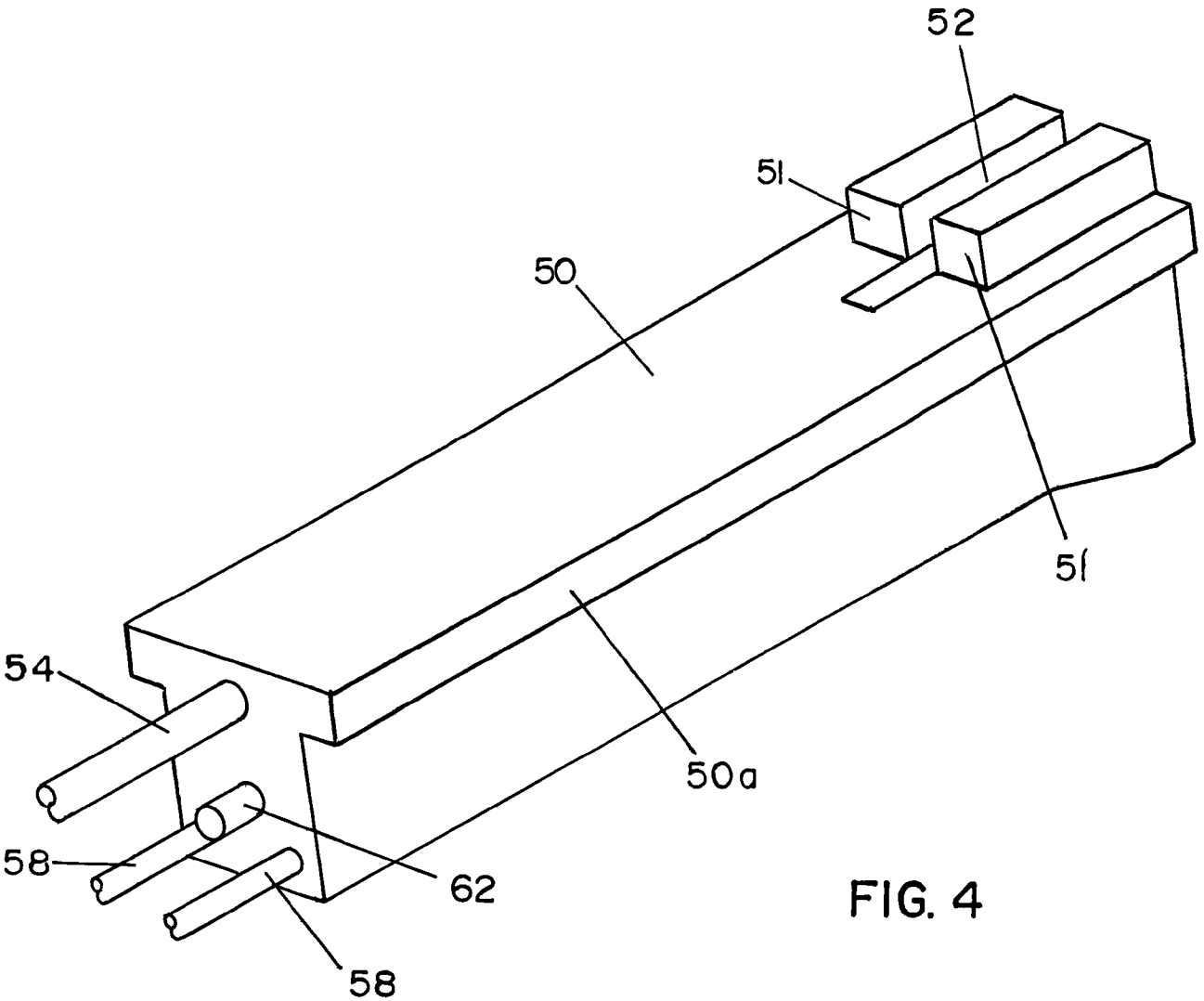
FIG. 4 is a generally perspective view of a portion of one form of the bolt of the improved firearm shown in FIG. 1.

A specially configured bolt 50 includes transversely spaced shoulders 50*a* that are slidably received within the transversely spaced guide grooves 30 (FIG. 3) formed in the upper receiver 26. Bolt 50 is movable between a first forward position shown in FIG. 1 of the drawings and a second rearward position. For a purpose presently to be described, bolt 50 is provided with a longitudinally extending guide slot 52 that is aligned with the guide slot 38 formed within the rear portion 34*b* of the barrel (FIGS. 2 and 4). Bolt biasing means are operably associated with the bolt 50 for yieldably resisting movement of the bolt between the first forward position and the second rearward position. In the present form of the invention, the bolt biasing means comprises an elongate guide rod 54 that is connected to and extends from the rear face of the bolt in the manner indicated in FIGS. 2 and 5 of the drawings. The bolt biasing means here also comprises a return spring 56 that circumscribes guide rod 54.

Also extending from the rear face of the bolt in the manner indicated in FIGS. 2 and 5 of the drawings is a pair of transversely spaced apart striker guide rods 58. Slidably carried by the striker guide rods for movement between a first rearward a second advanced position against the urging of striker biasing means, or a striker spring 59, that circumscribe the striker guide rods 58, is the important striker member 60 of the invention (see FIGS. 2 and 5). It is important to note that the striker 60 and the rods 58 not only reciprocate with bolt 50 as a unit (see FIG. 5), but striker 60 is also independently slidably movable along rods 58.

Associated with and carried by bolt 50 is the important firing mechanism of the invention. This firing mechanism here includes a firing pin 62 that is carried by bolt 50 for movement between a first rearward position shown in FIG. 1 and a second forward position. More particularly, firing pin 62 is carried within a longitudinally extending firing pin bore 64 formed in bolt 50 for reciprocal movement there within. In a manner presently to be described, when the striker member 60 is moved into the second advanced position shown in FIG. 5, it will engage end 62*a* of the firing pin 62 urging movement of the firing pin from the first retracted position toward the second advanced position in engagement with the cartridge disposed within the barrel 34.

Figure 6:
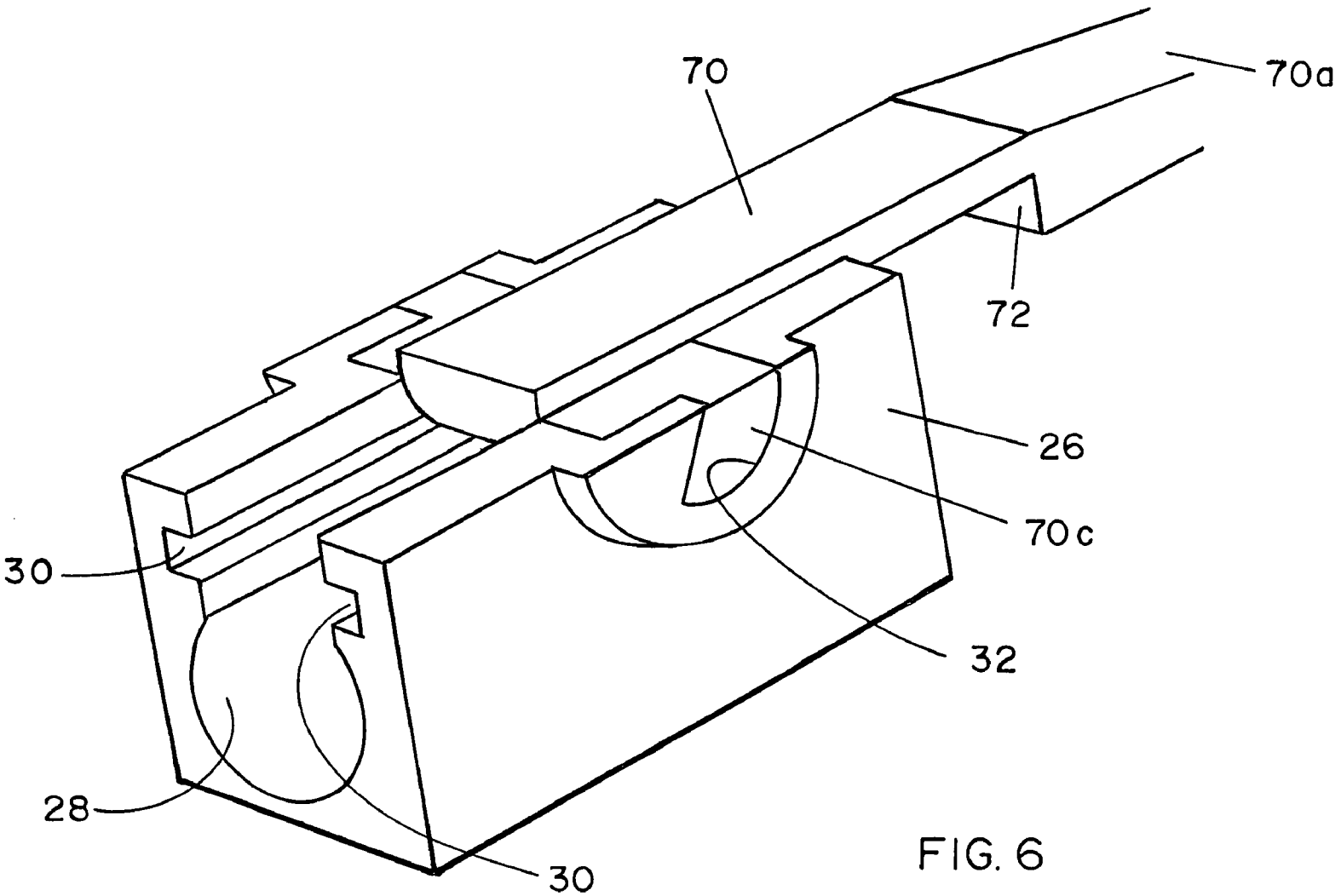
FIG. 6 is a fragmentary, generally perspective view illustrating the manner in which the locking member of the apparatus is received within the curved bearing surfaces of the upper receiver.
Figure 7:
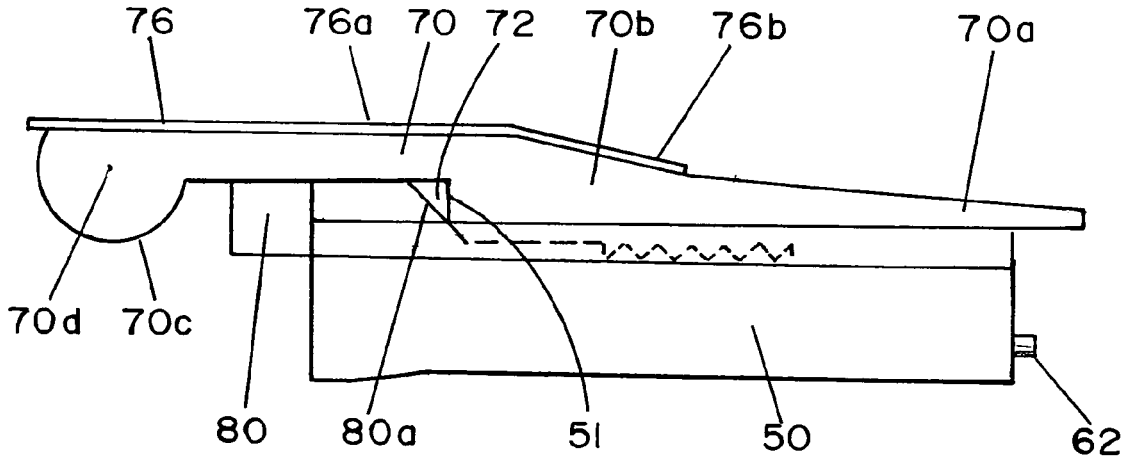
FIG. 7 is a fragmentary, side elevational view showing the locking member and the disengage member of the improved firearm interconnected with the bolt.
Figure 8:
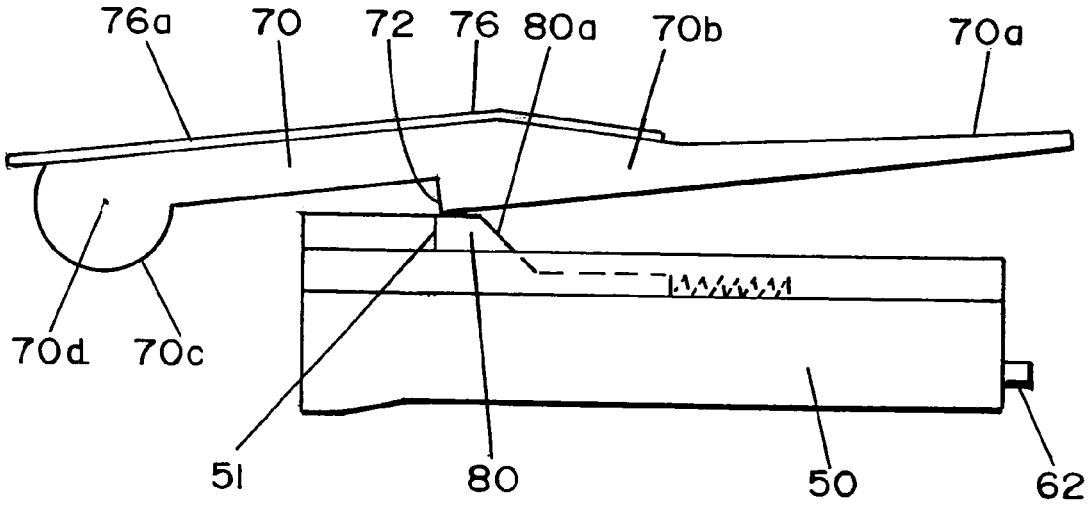
FIG. 8 is a fragmentary, side elevational view similar to FIG. 7, but showing the locking member having been moved into a bolt release position by the disengage member.

A novel and extremely important feature of the present invention is a uniquely configured bolt locking member 70 that is removably connected to said upper receiver for movement relative thereto between a first bolt engaging position shown in FIG. 7 and a second bolt disengage position shown in FIG. 8. As illustrated in FIGS. 7 and 8 of the drawings, bolt locking member 70 has a rearward angled tail portion 70*a*, a central portion 70*b* having a locking shoulder 72 and a curved forward portion 70*c* that is received within the semi-circular receiver bearing 32 of said upper receiver for rotational movement there within (see FIG. 6). As best seen in FIG. 1 of the drawings, when the bolt locking member 70 is in engagement with the bolt 50, the forward portion 70*c* of the locking member is disposed in engagement with the receiver bearings 32 and is also disposed in engagement with the pair of spaced apart, upstanding curved bearing surfaces 40 of the rear portion of the barrel 34. To continuously urge the locking member 70 into the first bolt engaging position shown in FIG. 1 of the drawings, locking member biasing means are provided. This locking member biasing means here comprises a flat spring 76 that is carried by the upper receiver in the manner shown in FIG. 1. Flat spring 76 includes a main body portion 76*a* and an angled tail portion 76*b* that engages the downwardly angled tail, or sloping wall portion 70*a* of the locking member (FIG. 7). Flat spring 76 is so constructed and arranged so as to continuously urge the locking member into the position shown in FIG. 1 of the drawings.

Forming another important aspect of the firearm of the present invention is a disengage member 80 that is slidably received within the guide slot 38 formed in the rear portion 34*b* of the barrel and within the longitudinally extending guide slot 52 of the bolt that is aligned with the guide slot 38. In a manner presently to be described, the disengage member 80 is movable by the operating rod 82 of the invention between a first forward position and a second rearward position. As best seen in FIGS. 1 and 8 of the drawings, disengage member 80 is provided with an angled wall 80*a* that is adapted to engage the locking shoulder 72 of the bolt locking member 70 to move the locking member into the upraised, bolt disengage position shown in FIG. 8 of the drawings. During this movement of the locking member, the curved forward portion 70*c* of the locking member will rotate within the semi-circular receiver bearing 42 of the upper receiver about a pivot point 70*d*. In the upraised position of the locking member, the locking shoulder 72 is free from the locking shoulders 51 of the bolt (FIG. 2) and the bolt is free to move rearwardly.

The previously identified operating rod 82 comprises a part of the operating rod assembly 84 of the invention that is carried by the barrel 34. In addition to the operating rod 82, the operating rod assembly 84 includes a piston housing 86 that is connected to the intermediate portion 34*c* of the barrel 34 and a piston 88 that is carried by said piston housing for reciprocal movement there within and for engagement with the operating rod 82. As indicated in FIG. 1 of the drawings, the intermediate portion 34*c* of the barrel is provided with a gas transfer passageway 90 that communicates with the piston housing and functions to transfer propellant gas under pressure from the barrel into the piston housing. After a round is fired, the propellant gas impinges on the piston 88, which acts upon the operating rod to move the operating rod between a first forward position and a second rearward position. In the rearward position, the operating rod engages the disengage member in a manner to move the disengage member from the bolt engaging position shown in FIG. 7 of the drawings into the bolt disengage position shown in FIG. 8. A coil spring 91 circumscribes the operating rod 82 (FIGS. 1 and 2) and functions to move the operating rod from the second rearward position toward the following firing of the bullet.

Connected to upper receiver 26 to form a receiver 92 is a lower receiver 94 (FIG. 1). Connected to and extending from lower receiver 94, is a conventional magazine 96 that functions to carry a plurality of ammunition cartridges, such as cartridge "AC" (FIG. 1). Also carried by lower receiver 94 is a trigger mechanism that is generally designated by the numeral 98. In a manner presently to be described, trigger mechanism 98 is operably associated with the previously identified striker member 60 via a sear member, the nature of which will presently be described.

Figure 9:
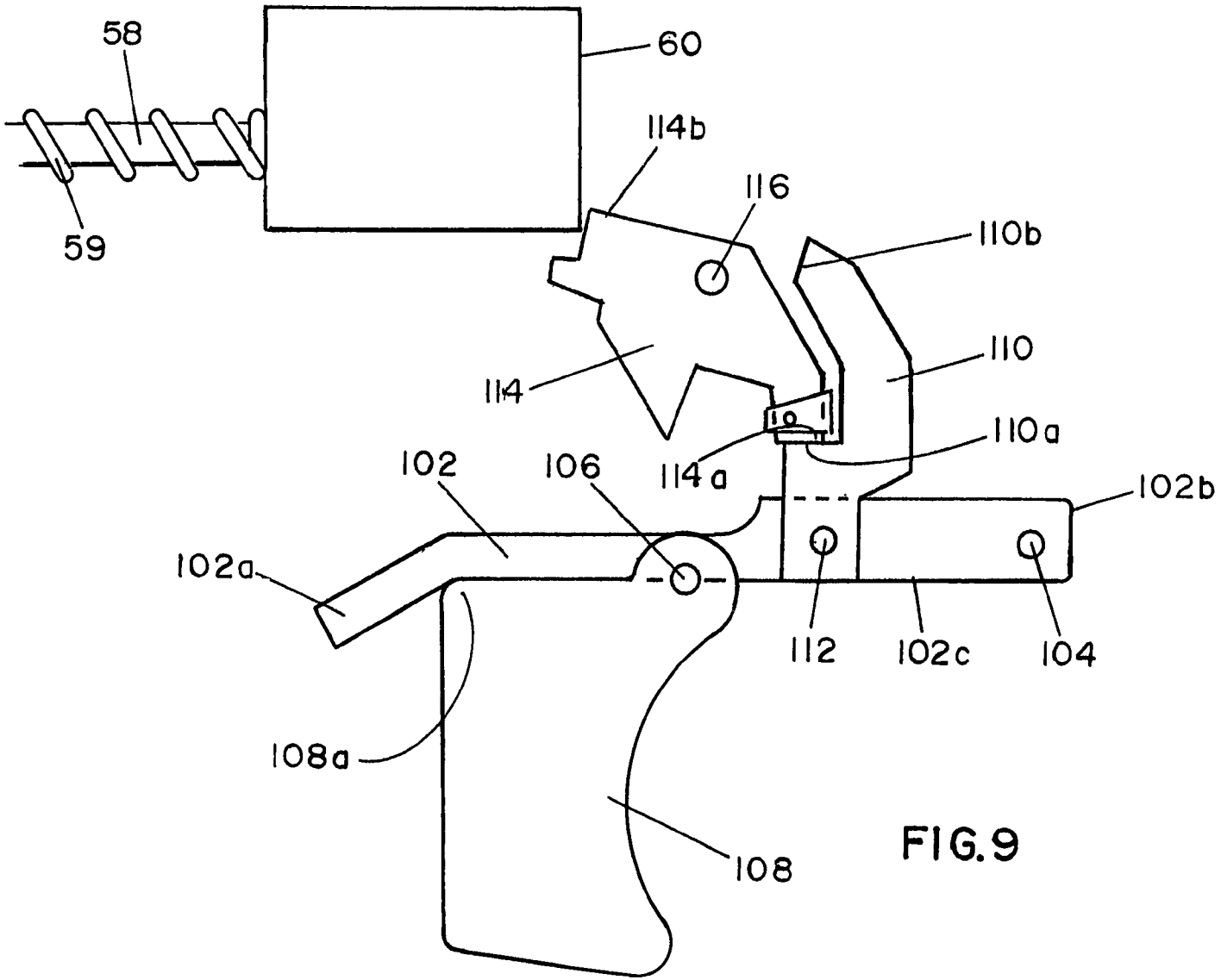
FIG. 9 is a greatly enlarged, fragmentary side elevational view illustrating the construction of the trigger mechanism of the improved firearm and the association of the trigger mechanism with the sear and with the striker member.
Figure 9C:
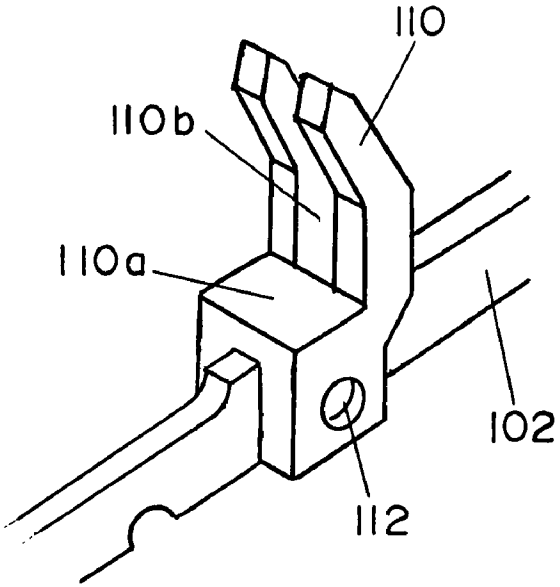
FIG. 9C is a generally perspective front view of the lifter interconnected with the lift bar of the trigger mechanism.

In the present form of the invention, the novel trigger mechanism 98 comprises a trigger housing 100 and a uniquely configured lift bar 102 that is pivotally connected to the trigger housing in the manner shown in FIGS. 1 and 9 of the drawings. Lift bar 102, which pivots about a pivot point 104, has a first end 102*a*, a second end 102*b* and an intermediate portion 102*c*.

Also pivotally connected to trigger housing 100 for pivotal movement about a pivot point 106, is a trigger 108. Trigger 108, which is operably associated with lift bar 102, functions to lift the first end 102*a* of the lift bar upon pivotal movement of the trigger manner shown in FIG. 10 of the drawings.

Figure 10:
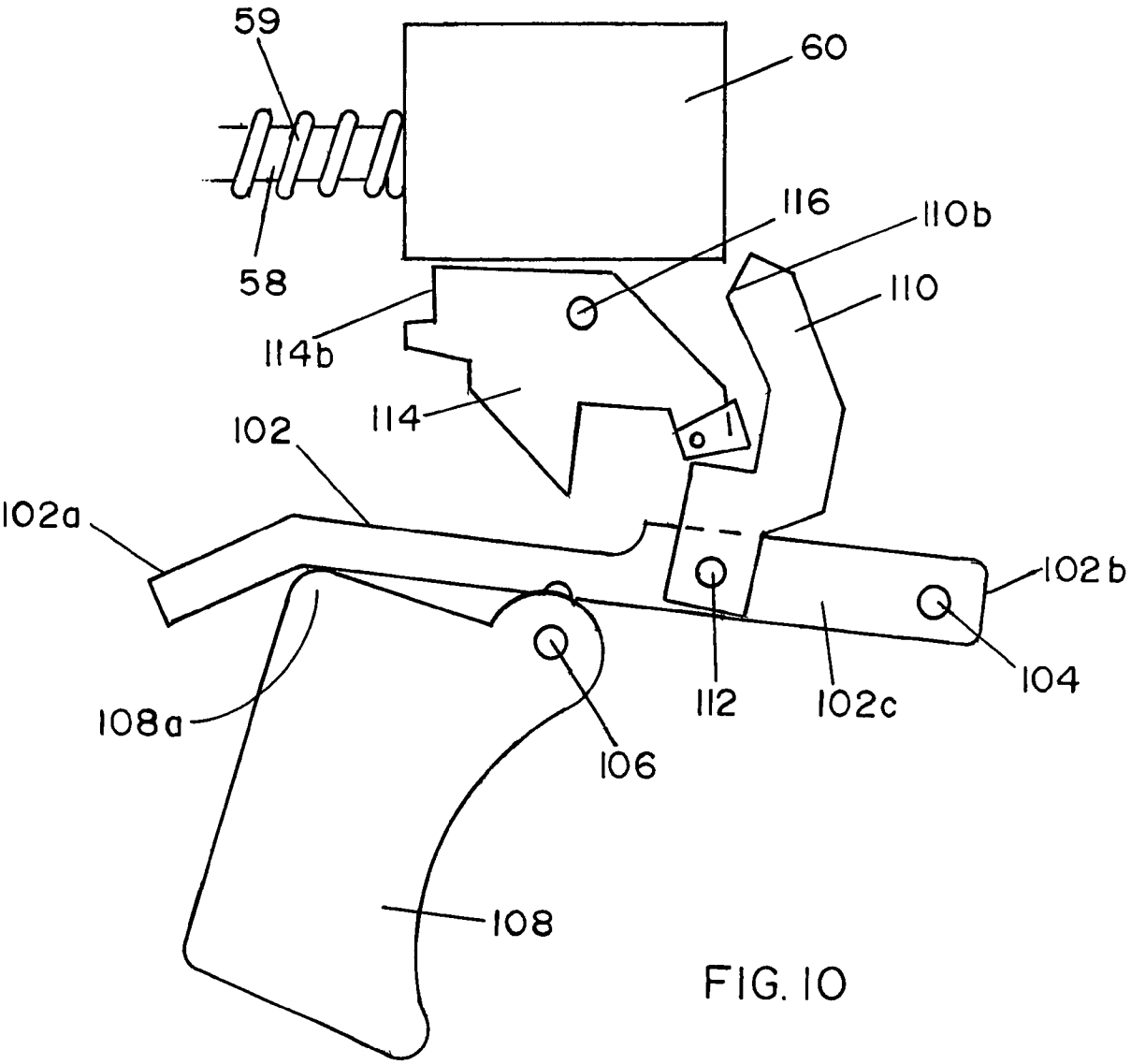
FIG. 10 is a greatly enlarged, fragmentary side elevational view illustrating the configuration of the trigger mechanism following the pivotal movement of the trigger into a position to cause the release of the striker member.
Figure 10A:
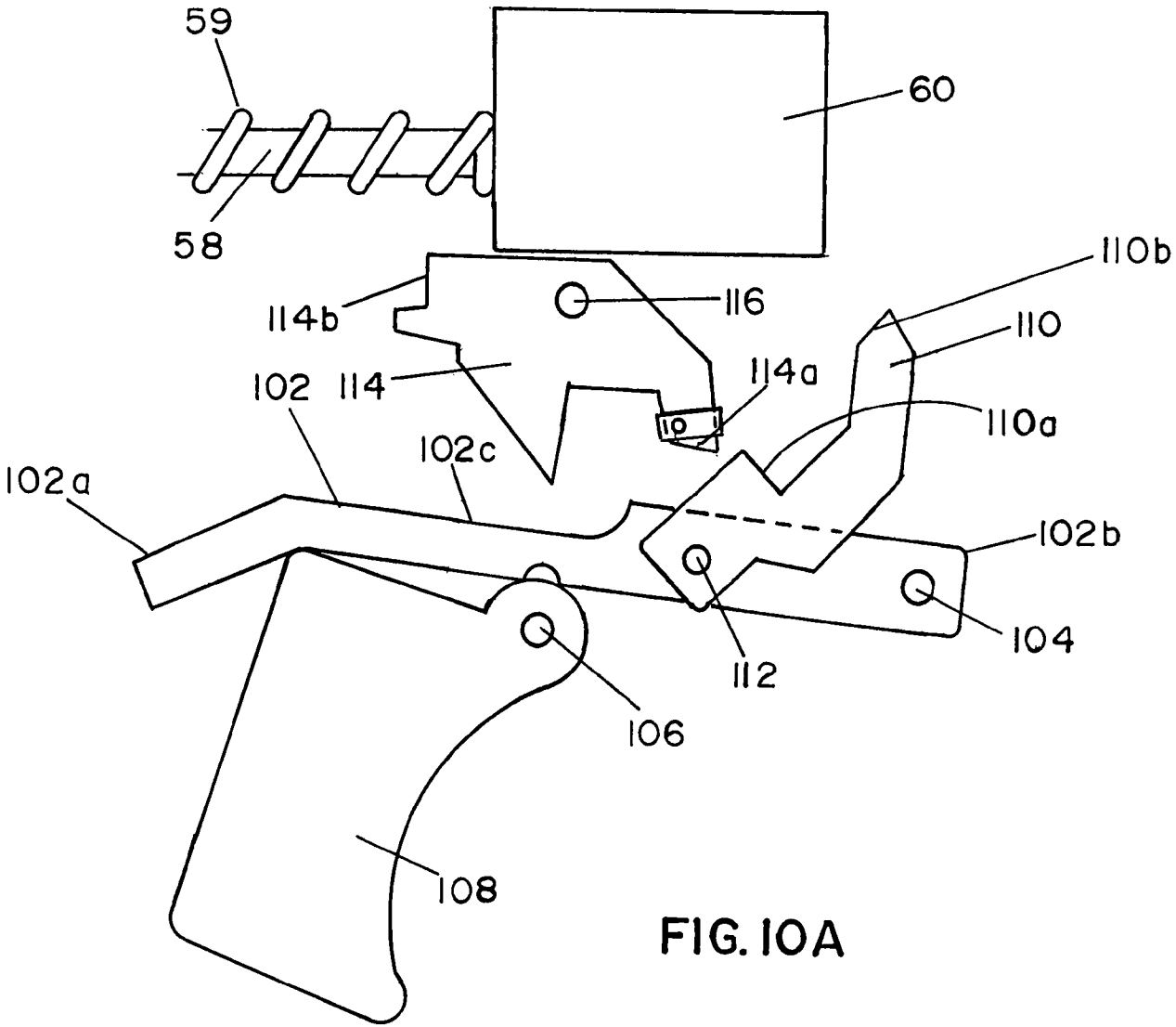
FIG. 10A is a greatly enlarged, fragmentary side view illustrating the configuration of the trigger mechanism following the pivotal movement of the lifter by the action of the forward movement of the striker member.

Pivotally connected to the lift bar 102 for movement between a first position shown in shown in FIG. 9 and a second position shown in FIG. 10A, is a specially configured lifter member 110. Lifter member 110, which is adapted to pivot relative to the lift bar about a pivot point 112, is provided with a shoulder 110*a*, the purpose of which will presently be described.

Figure 9B:
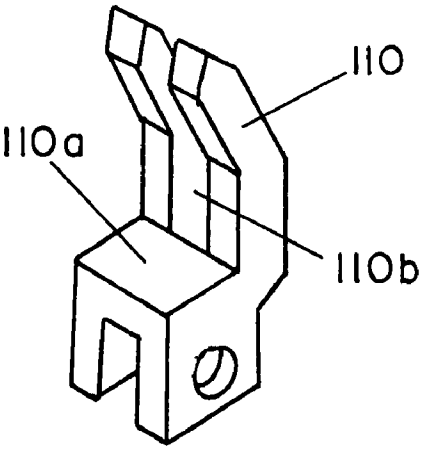
FIG. 9B is a generally perspective rear view of the lifter of the trigger mechanism.
Figure 9A:
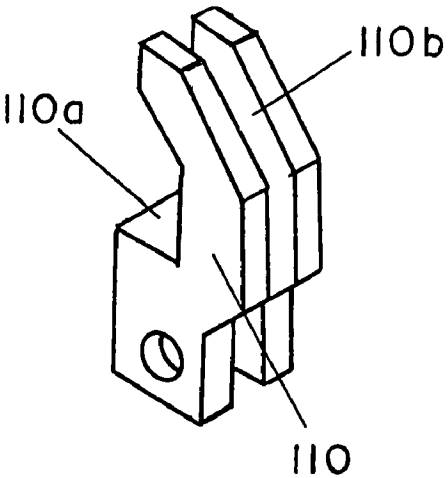
FIG. 9A is a generally perspective front view of the lifter of the trigger mechanism.

As illustrated in FIGS. 9A and 9B of the drawings, the lifter member 110 is also provided with a longitudinally extending slot 110*b* that receives a portion of intermediate portion 102*c* of the lift bar and enables the lifting member to pivot relative to the lift bar.

Operably associated with striker member 60 and with lifter member 110 is a sear 114. Sear 114 which forms a part of the upper receiver 26 is pivotally connected to the upper receiver 26 for pivotal movement about a pivot point 116. In a manner presently to be described, sear 114 controls the movement of the striker member 60 between the first position shown in FIG. 1 and a second advanced position shown in FIG. 5, wherein the striker member is in engagement with the firing pin 62.

With the construction described in the preceding paragraphs, when the user pulls the trigger 108, the trigger will pivot about pivot point 106 causing the trigger corner 108*a* to lift the first end 102*a* of the lift bar into the upraised position shown in FIG. 10 of the drawings. This pivotal movement of the lift bar will, in turn, cause the lifter member 110 to rise upwardly and into the position shown in FIG. 10. As the lifter member rises, the shoulder 110*a* of the lifter member, which is in engagement with extremity 114*a* of the sear 114 (see FIG. 9), will cause the sear to pivot about its pivot axis 116. As the sear 114 pivots into the position shown in FIG. 10 of the drawings, extremity 114*b* of the sear 114 will move out of engagement with the striker member 60 permitting the striker biasing means or spring 59 to urge the striker forward into engagement with face 110*b* of the lift member (FIG. 10) causing the lift member to pivot relative to lift bar 102 about pivot point 112 into the position shown in FIG. 10A of the drawings. In this position extremity 114*a* is free from shoulder 110*a* so that the sear 114 can pivot upwardly about pivot point 116 so as to be in position to once again engage the striker in the manner shown in FIG. 9. After engaging the face 110*b* of the lifter member the striker member will continue to be urged forwardly by the springs 59 into the second position wherein the striker member 60 engages the firing pin 62 (see FIG. 5) which forms a part of the novel ignition system of the invention causing it to move forward within the bolt and to strike and fire the cartridge housed within a chamber of the barrel (not shown).

Launching of the bullet through the barrel will result in the propellant gas generated by the launch being transferred under pressure from the barrel into the piston housing 86 via the gas transfer passageway 90. The propellant gas introduced into the piston housing impinges on the piston 88, which, in turn, acts upon the operating rod 82 to move the operating rod between a first forward position and a second rearward position. In the rearward position the operating rod 82 engages the disengage member 80 in a manner to move the disengage member from the bolt engaging position shown in FIG. 7 of the drawings into the bolt disengage position shown in FIG. 8. Upon release of the bolt 50, the bolt, along with the striker member 60, will move from the first forward position to the second rearward position against the urging of the bolt biasing means, or return spring 56. Recoil retraction of the bolt will result in the ejection of the fired cartridge.

Following retraction of the bolt 50, the return spring 56 will act upon the assembly comprising the bolt and the striker causing it to move forward and will cause the sear 114 to move into the locked position shown in FIG. 9 of the drawings. The striker will remain in this rearward, locked position pending further operation of the trigger mechanism. In this rearward position, the locking member biasing means, or flat spring 76, will force the locking member into the first bolt engaging position shown in FIGS. 1 and 7 wherein the curved forward portion 70*c* of the locking member is received within the semi-circular receiver bearing 42 of said upper receiver, thereby once again locking the bolt in the forward position.

A unique feature of the firearm of the present invention resides in the method by which the barrel 34 can be removed for cleaning or replacement. In this regard, when the barrel 34 is in position within the receiver 26 in the manner shown in FIGS. 1 and 3 of the drawings, insertion of portion 70*c* of the locking member into the semi-circular receiver bearing 42 of said upper receiver will securely lock the barrel in position within the receiver. In order to remove the barrel from the receiver, the cover 122 of the firearm (FIG. 1) must first be removed so as to expose spring 76 and locking member 70. By grasping portion 70*a* of the locking member and exerting an upward pressure thereon, the curved forward portion 70*c* of the locking member will be caused to rotate within the semi-circular receiver bearing 42 of the upper receiver about a pivot point 70*d*. In the upraised position, the locking member can be lifted from the receiver thereby permitting the barrel be conveniently, slidably removed from the receiver 26.

Having now described the invention in detail in accordance with the requirements of the patent statues, those skilled in this art will have no difficulty in making changes and modifications in the individual parts or their relative assembly in order to meet specific requirements or conditions. Such changes and modifications may be made without departing from the scope and spirit of the invention, as set forth in the following claims.

The invention claimed is:

1. In combination, a firearm having an upper receiver, an operating rod operably associated with said upper receiver for movement between a first position and a second position, a lower receiver connected to said upper receiver, a trigger mechanism carried by said lower receiver and a magazine connected to said lower receiver for carrying a plurality of ammunition cartridges, the improvement comprising:

(a) a barrel connected to said upper receiver, said barrel having a rear portion having a guide slot and a curved bearing surface and an intermediate portion having a gas transfer passageway formed therein;

(b) a generally semi-circular receiver bearing formed in said upper receiver;

(c) a bolt slidably received within said upper receiver for movement between a first forward position and a second rearward position, said bolt having a longitudinally extending guide slot;

(d) a firing pin carried by said bolt for movement between a first position and a second position;

(e) a striker connected to said bolt for movement between a first position and a second position in engagement with said firing pin;

(f) a locking member removably connected to said upper receiver for movement relative thereto between a first bolt engaging position and a second bolt disengage position, said locking member having a rearward portion, a central portion having a locking shoulder and a curved forward portion received within said generally semi-circular bore of said upper receiver and within said curved bearing surface of said barrel;

(g) locking member biasing means carried by said upper receiver for urging said locking member into said first bolt engaging position; and (h) a disengage member slidably received within said longitudinally extending guide slot of said bolt and within said guide slot of said barrel for movement by said operating rod between a first position and a second position, said disengage member having a wall for engagement with said locking member to move said locking member into said bolt disengage position upon movement of said disengage member to said second position.

2. The firearm as defined in claim 1 in which said improvement further comprises bolt biasing means for yieldably resisting movement of said bolt between a first forward position and a second rearward position.

3. The firearm as defined in claim 1 in which said improvement further comprises striker biasing means connected to said striker for urging movement of said striker from said first position toward said second position in engagement with said firing pin.

4. The firearm as defined in claim 1 further including a piston housing connected to said barrel, a piston carried by said piston housing for engagement with said operating rod and a gas transfer passageway communicating with the barrel for transferring propellant gas pressure therefrom into said piston housing.

5. The firearm as defined in claim 1 in which said trigger mechanism comprises:

(a) a trigger housing;

(b) a lift bar pivotally connected to said trigger housing, said lift bar having a first end, a second end and an intermediate portion;

(c) a trigger pivotally connected to said trigger housing and operably associated with said lift bar for lifting said first end of said lift bar upon pivotal movement of said trigger; and (d) a lifter member pivotally connected to said lift bar for movement between a first position and a second position for engagement with said sear to move said sear toward said second position of said sear.

6. In combination, a firearm having an upper receiver, a barrel connected to said upper receiver, an operating rod carried by and operably associated with said barrel for movement between a first position and a second position, a lower receiver connected to said upper receiver and a magazine connected to said lower receiver for carrying a plurality of ammunition cartridges, the improvement comprising:

(a) a generally semi-circular receiver bearing formed in said upper receiver;

(b) a bolt slidably received within said upper receiver for movement between a first forward position and a second rearward position, said bolt having a longitudinally extending guide slot;

(c) a firing pin carried by said bolt for movement between a first position and a second position;

(d) a striker connected to said bolt for movement between a first position and a second position in engagement with said firing pin;

(e) a locking member removably connected to said upper receiver for movement relative thereto between a first bolt engaging position and a second bolt disengage position, said locking member having a rearward portion, a central portion having a locking shoulder and a curved forward portion received within said generally semi-circular bore of said upper receiver;

(f) locking member biasing means carried by said upper receiver for urging said locking member into said first bolt engaging position;

(g) a disengage member slidably received within said longitudinally extending guide slot of said bolt for movement by said operating rod between a first position and a second position, said disengage member having a wall for engagement with said locking member to move said locking member into said bolt disengage position upon movement of said disengage member to said second position; and (h) a sear operably associated with said striker, said sear being pivotally connected to said upper receiver for movement between first and second positions; and (i) a trigger mechanism connected to said lower receiver, said trigger mechanism comprising:

i. a trigger housing;

ii. a lift bar pivotally connected to said trigger housing, said lift bar having a first end, a second end and an intermediate portion;

iii. a trigger pivotally connected to said trigger housing and operably associated with said lift bar for lifting said first end of said lift bar upon pivotal movement of said trigger; and iv. a lifter member pivotally connected to said lift bar for movement between a first position and a second position to engage said sear to move said sear towards said second position of said sear.

7. The combination as defined in claim 6 in which said sear includes a shoulder for engaging said striker when said striker is in said first position.

8. The combination as defined in claim 6 in which said trigger includes a transversely extending pivot pin and in which said intermediate portion of said locking member is provided with a groove for receiving said transversely extending pivot pin.

9. A firearm comprising:

(a) an upper receiver having a barrel receiving bore, a pair of transversely spaced guide grooves and a generally semi-circular bore;

(b) a barrel having a forward portion and a rear portion having a curved bearing surface, said rear portion being telescopically receivable within said barrel receiving bore;

(c) a bolt slidably received within said transversely spaced guide grooves of said upper receiver for movement between a first forward position and a second rearward position, said bolt having a longitudinally extending guide slot;

(d) a striker connected to said bolt for movement between a first position and a second position in engagement with said firing pin;

(e) a firing mechanism associated with and carried by said bolt, said firing mechanism including a firing pin carried by said bolt for movement between a first rearward position and a second forward position;

(f) a locking member removably connected to said upper receiver for movement relative thereto between a first bolt engaging position and a second bolt disengage position, said locking member having a rearward portion, a central portion having a locking shoulder and a curved forward portion received within said generally semi-circular bore of said upper receiver and disposed in engagement with said curved bearing surface of said rear portion of said barrel;

(g) biasing means carried by said upper receiver for urging said locking member into said first bolt engaging position;

(h) a disengage member slidably received within said longitudinally extending guide slot of said bolt for movement between a first position and a second position, said disengage member having an angled wall for engagement with said locking member to move said locking member into said bolt disengage position;

(i) an operating rod carried by and operably associated with said barrel for movement between a first position and a second position in engagement with said disengage member for moving said disengage member into said bolt disengage position;

(j) a sear operably associated with said striker and pivotally connected to said upper receiver for movement between first and second positions;

(k) a lower receiver connected to said upper receiver;

(l) a trigger mechanism carried by said lower receiver and operably associated with said striker; and (m) a magazine connected to said lower receiver for carrying a plurality of ammunition cartridges.

* * * * *